United States Patent [19]

Dobbs

[11] Patent Number: 4,932,077

[45] Date of Patent: Jun. 12, 1990

[54] LAP ROBE FOR WHEELCHAIR OCCUPANT

[76] Inventor: Dolores Dobbs, 3372 Fieldstone Dr., Doylestown, Pa. 18901

[21] Appl. No.: 349,485

[22] Filed: May 9, 1989

[51] Int. Cl.[5] ..... A47G 9/02; A41D 27/12

[52] U.S. Cl. ..... 2/69.5; 2/47; 2/69; 5/485

[58] Field of Search ..... 2/47, 48, 69, 69.5, 2/83, 114, 70, 71, 72, 46, 47; 5/482, 484, 485

[56] References Cited

U.S. PATENT DOCUMENTS

| | | | |
|---|---|---|---|
| 823,469 | 6/1906 | Hoenigsberger | 2/69 |
| 1,724,443 | 8/1929 | Wheeler | 2/69 |
| 2,504,761 | 1/1948 | Turco | 5/485 |
| 3,085,248 | 4/1963 | Benson | 2/46 |
| 3,514,796 | 10/1967 | Dibrell | 5/485 |
| 3,727,238 | 4/1973 | Wolfson | 2/47 X |
| 4,363,141 | 12/1982 | Doster | 2/69.5 |
| 4,514,870 | 5/1985 | Tyler, Jr. | 2/69 X |
| 4,651,346 | 3/1987 | Hale | 2/69 X |
| 4,833,731 | 5/1989 | Foxman | 2/DIG. 7 X |

*Primary Examiner*—Werner H. Schroeder
*Assistant Examiner*—Jeanette E. Chapman
*Attorney, Agent, or Firm*—Gregory J. Gore

[57] ABSTRACT

A double-layer lap blanket is affixed to two leg extensions so that the medical garment assures full frontal coverage of the patent from his feet to his waist while seated in a wheelchair. Each leg extension contains an elongated pocket which is provided to receive the foot and lower half of the leg below the knee forming a legging. The entire lower half of the lower leg and both feet are therefore fully covered by this garment. Attachment of the leggings to the lap blanket provides a garment of unitary construction and secures the lap blanket from sliding off the wearer's lap.

3 Claims, 1 Drawing Sheet

LAP ROBE FOR WHEELCHAIR OCCUPANT

FIELD OF THE INVENTION

This invention relates to medical garments and, more particularly, to a garment for a wheelchair occupant that covers the lower half of the occupant's torso and legs.

BACKGROUND OF THE INVENTION

Various medical garments have been devised for the comfort of wheelchair occupants in order to accommodate their specific requirements. For example, U.S. Pat. No. 4,764,985 issued to Vicki J. Wade, describes a poncho-type garment with corner reliefs which would otherwise be wadded inside the chair frame or left dangling outside. The Wade garment and others, however, predominantly stress bodily coverage of the upper torso of the user.

When using a normal hospital gown, it is usually the feet and backs of the legs of the patient which are left uncovered. In order to keep the wheelchair occupant warm, various lap robes have been used to supplement the minimal coverage of the hospital gown. However these garments, even when draped down the entire front of the user, do not adequately cover the feet and the backs of the legs which are left exposed. Hence, there is a need for a garment which adequately covers and protects the legs and lower part of the wheelchair occupant's torso.

BRIEF SUMMARY OF THE INVENTION

In order to meet the inadequacy of prior art medical garments and to satisfy the need as explained above, the present garment has been devised. A double-layer lap blanket portion is affixed to two leg extensions, each leg extension contains an elongate pocket which is provided to receive the foot and lower half of the leg below the knee forming a legging. Thereby, the entire lower half of the leg and both feet are fully covered by this garment. Attachment to the lap blanket portion provides a garment of unitary construction and secures the lap blanket from sliding off the wearer's lap. Furthermore, the garment ensures full, frontal coverage of the patient from his feet to his waist.

Simple, side seams form the construction of the leggings. The doubling over and attachment of the blanket portion to the legging is accomplished with the same stitching. Hence, the present garment can be manufactured from only two pieces of cloth sewn together in a very uncomplicated manner adding to its low cost of manufacture.

Because the present garment covers the user only from the waist down, the upper portion of the torso is left unencumbered and therefore it can be worn in combination with any other garments designed for the upper torso. Other advantages will be readily apparent from those of ordinary skill in the field of medical garments from the following drawings and description of the preferred embodiment.

DESCRIPTION OF THE PREFERRED EMBODIMENT

Figure 1:
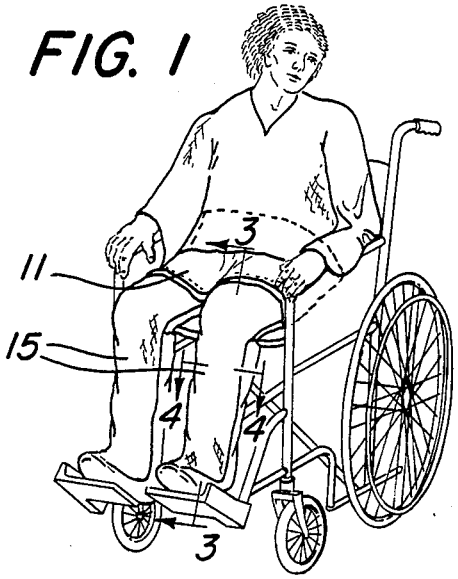
FIG. 1 is a top right isometric view of the present medical garment in use by a wheelchair occupant.
Figure 4:
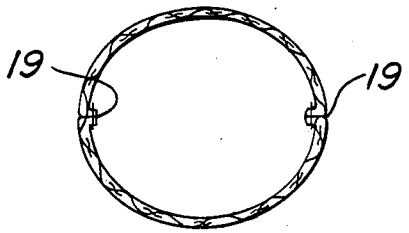
FIG. 4 is a top sectional view taken from FIG. 1 showing the side seam construction of the leggings.
Figure 2:
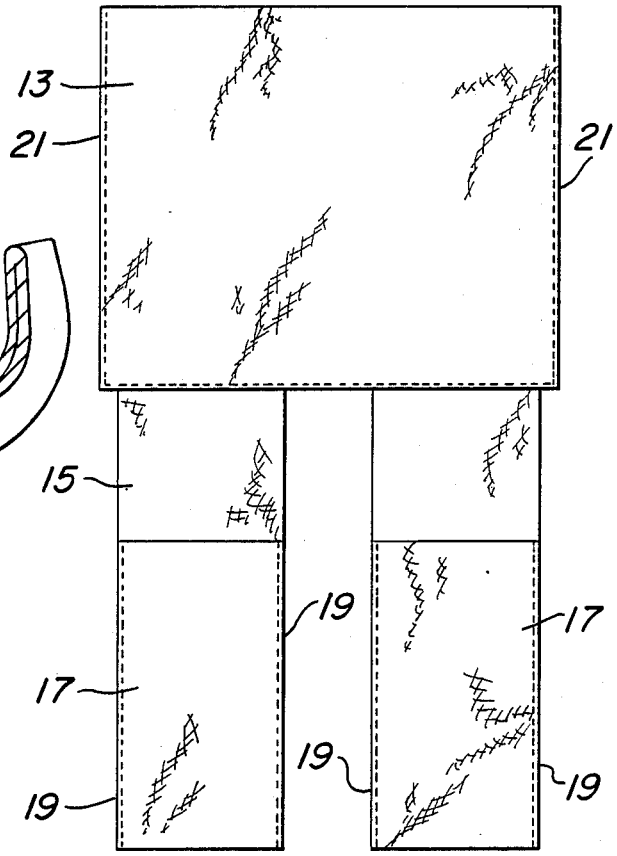
FIG. 2 is a rear view of the present garment.
Figure 3:
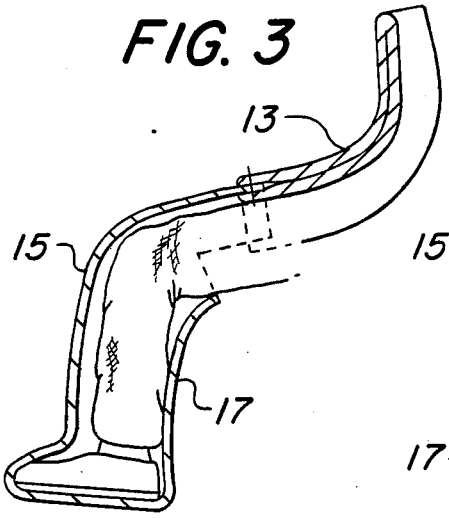
FIG. 3 is a side sectional view taken from FIG. 1 showing the location of the present medical garment on the body of the user and the method of joining the lap blanket portion and the leggings portion.

Referring now to FIG. 1, the present garment is shown being worn by a wheelchair occupant. The basic garment includes a substantially rectangular lap blanket portion 11 with leggings 15 attached at the bottom. As depicted in this figure, the entire frontal area of the wearer's body is covered from the waist down, including the toes and feet. This is more clearly depicted in FIG. 3. Lap blanket portion 13 is folded at the top, thus creating a double-layer construction. The bottom of the lap blanket is attached to the top of the legging panels 15 by the same stitching that secures the lap blanket fold. The top of the leg extensions are sewn between the lap blanket fold, as shown in FIG. 3. As shown in FIG. 2, the leggings are constructed by folding back and side-stitching two rectangular elongate pieces of fabric 15. This creates two long, tubular pockets for receiving the feet and lower legs of the wearer which have openings at the back side of the garment. The back panel of the leggings 17 is of sufficient height to cover the entire calf portion of the wearer's leg and to extend up behind the knee to a point where the wheelchair occupant's leg meets the wheelchair seat. As shown in FIG. 4, each legging is constructed by simply side-stitching seams 19 to form a closed-ended tubular boot which covers the feet and legs to a height as described above.

Any convenient fabric can be used. Because this garment is formed by the use of two separate pieces of cloth, different cloths may be used for the leggings and lap blanket. The lap blanket is preferably of a heavier weight material. Dimensions may be altered to suit wheelchair occupants of different sizes.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

What is claimed is:

1. A medical garment for a wheelchair occupant, comprising:

a. a substantially rectangular lap blanket portion;

b. a pair of leggings sewn to the bottom edge of said lap blanket, said leggings including elongate pockets for receiving and covering the feet and lower legs of said occupant; wherein the pocket openings of said leggings are at the back side of the garment, said blanket portion is of double-layer construction formed by folding over a single piece of fabric, and said lap blanket portion and said leggings are composed of different types of fabric.

2. The medical garment of claim 1 wherein said legging portions are sewn to said lap blanket portion with the top of the leggings sewn between said layers of said lap blanket portion.

3. The medical garment of claim 1 where the pocket formed in the bottom of each legging is created by folding over a single piece of cloth and sewing together the side edges.

* * * * *